United States Patent [19]

Beeman

[11] 4,372,403

[45] Feb. 8, 1983

[54] ECCENTRIC ROTARY BIT

[76] Inventor: Archie W. Beeman, 501 Hillcrest, Odessa, Tex. 79760

[21] Appl. No.: 301,766

[22] Filed: Sep. 14, 1981

[51] Int. Cl.[3] ..... E21B 10/08

[52] U.S. Cl. ..... 175/343

[58] Field of Search ..... 175/343, 348, 349

[56] References Cited

U.S. PATENT DOCUMENTS

| | | | |
|---|---|---|---|
| 2,336,335 | 12/1943 | Zublin | 175/348 |
| 2,336,337 | 12/1943 | Zublin | 175/348 |
| 2,362,860 | 11/1944 | Rossman | 175/348 |
| 4,168,755 | 9/1979 | Willis | 175/343 |

*Primary Examiner*—Stephen J. Novosad
*Assistant Examiner*—Joseph Falk
*Attorney, Agent, or Firm*—Marcus L. Bates

[57] ABSTRACT

A rotary drill bit has an upper rotatable main body member which rotates respective to a lower stationary bit member. The lower stationary bit member has an axial centerline arranged at an angle respective to the axial centerline of the upper body member. The lower face of the lower bit member terminates in a formation engaging surface which is in the form of a cone so that as the drill string imparts rotation into the main body member, the face of the lower member engages the formation and is wobbled by the action of the rotating main body. This action forces a limited area along one side of the conical face to bear against the formation. The formation engaging portion of the bit face travels circumferentially about the bit due to the eccentricity or misalignment of the two bit members. The wobble action imparts great pressure on the bottom of the borehole, increases penetration of the bit, and reduces wear on the cutting elements of the bit face.

6 Claims, 3 Drawing Figures

ECCENTRIC ROTARY BIT

BACKGROUND OF THE INVENTION

Rotary drill bits for penetrating geological formations take on all sorts of different forms. When any bit engages rock-like material, the rate of penetration becomes extremely slow, and in order to increase the rate of penetration, it is common to apply as much downward force onto the cutting face of the bit as may be practical. In order to achieve this increase in downward force on the bit, it is often necessary to employ massive steel cylinders called drill collars, or otherwise, the borehole may deviate from a straight line which results in a crooked hole.

In order to increase the rate of penetration without subjecting the drill bit to excessive downward force, the present invention provides a formation engaging face in the form of a cone having a centerline arranged at an angle respective to the centerline of the upper part or main body of the bit. The bit main body rotates while the formation engaging member remains nonrotatable so that the resultant cooperative action therebetween causes the lower member to wobble, thereby engaging the bottom of the borehole with a force which is directed mostly along a limited area of one side of the cone, with this formation engaging area traveling circumferentially about the bit face in accordance with the relative position of the two members respective to one another.

Since only a small area of the face of the lower member is urged against the formation, the downward force on the bit is distributed over a relatively small area, thereby providing an unusual large force between the cutting elements of the bit and the formation.

SUMMARY OF THE INVENTION

An eccentric rotary drill bit having an upper rotatable main body member. An axial passageway is formed through one marginal end of the upper member, and a counterbore is formed at the opposite end thereof, with the counterbore having an axial centerline which lies at an angle respective to the axial passageway. A circumferentially extending shoulder is formed about the counterbore and provides one of a pair of confronting bearing races for the drill bit. A relatively non-rotatable ground engaging lower bit member is affixed to the upper member in low friction relationship therewith. The lower member includes an upstanding cylinder having an axial centerline which coincides with the axial centerline of the downwardly directed counterbore of the main body member. A circumferentially extending shoulder formed about the cylinder provides a second of the confronting bearing races so that a relatively large bearing can be positioned in captured relationship between the two shoulders.

The outer surface of the cylinder and the inner surface of the downwardly directed counterbore are fastened to one another by a low friction rotatable fastener means so that one member is captured to the other in a rotatable manner. A fluid passageway extends from the axial passageway into the interior of the cylinder, where a plurality of flow passageways conduct fluid to the cutting face of the bit. The face of the bit is provided with suitable formation cutting element. The opposed side of the ground engaging conical bit face is parallel to the confronting bearing races.

The cylinder preferably is rotatably captured within the downwardly directed counterbore by a plurality of balls which are inserted through the sidewall of the main body and which reside within a circumferentially extending groove formed jointly on the interior of the counterbore and the exterior of the cylinder.

Accordingly, a primary object of the present invention is to provide a rotary drill bit having a non-rotatable conical bit face which engages the formation with a wobble-like action.

Another object of the present invention is the provision of a drill bit having an upper rotating member which wobbles a lower non-rotating member and causes the lower member to engage and rapidly penetrate a formation.

An additional object of the present invention is the provision of a drill bit improvement wherein a lower conical bit member is forced into engagement with a formation by a force which moves circumferentially about the bit member.

Still another object of the present invention is the provision of a drill bit which includes a non-rotatable bit member having a conical face, the bit member is attached to a main rotatable body which terminates in a plane, the plane is parallel to one side of the conical bit face.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
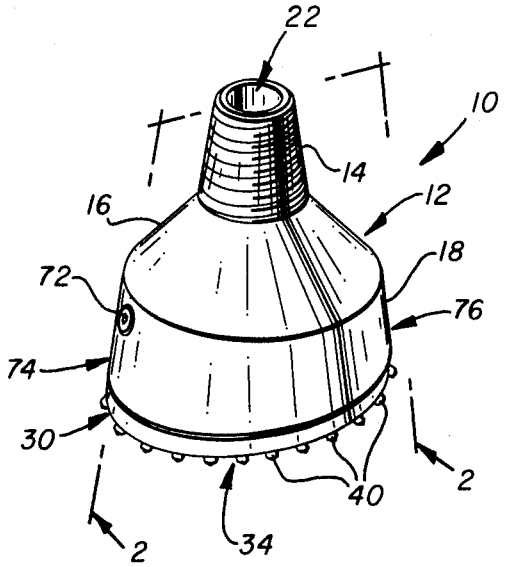
FIG. 1 is a perspective view which discloses one form of the present invention.

In the figures of the drawings, there is disclosed a drill bit 10 made in accordance with the present invention. The drill bit includes a main rotating upper body member 12 which terminates at the upper end thereof in a fastener means 14, which preferably is a threaded surface. The body outwardly slopes at 16 to form a frustum of a cone, although other configurations of this external portion of the drill bit could be employed while staying within the confines of the present invention. The bit body includes circumferentially extending sidewall 18 which has a lowermost edge portion 20 terminated by a plane which lies non-perpendicularly respective to the axial centerline of the bit.

The main body of the bit is provided with an axial passageway 22 at one end thereof which enlarges into a chamber at the other end thereof, with the chamber being in the form of a counterbore. The counterbore or chamber includes an upper wall 24 and a circumferentially extending sidewall 26. The sidewall 26 is surrounded by a circumferentially extending shoulder 28, which also forms a bearing race, or a shoulder for receiving the race of a bearing, as the case may be. The bearing race is terminated by the downwardly projected wall which defines the inner edge of the before mentioned lower face 20 of the main rotatable upper body member of the bit.

Figure 2:
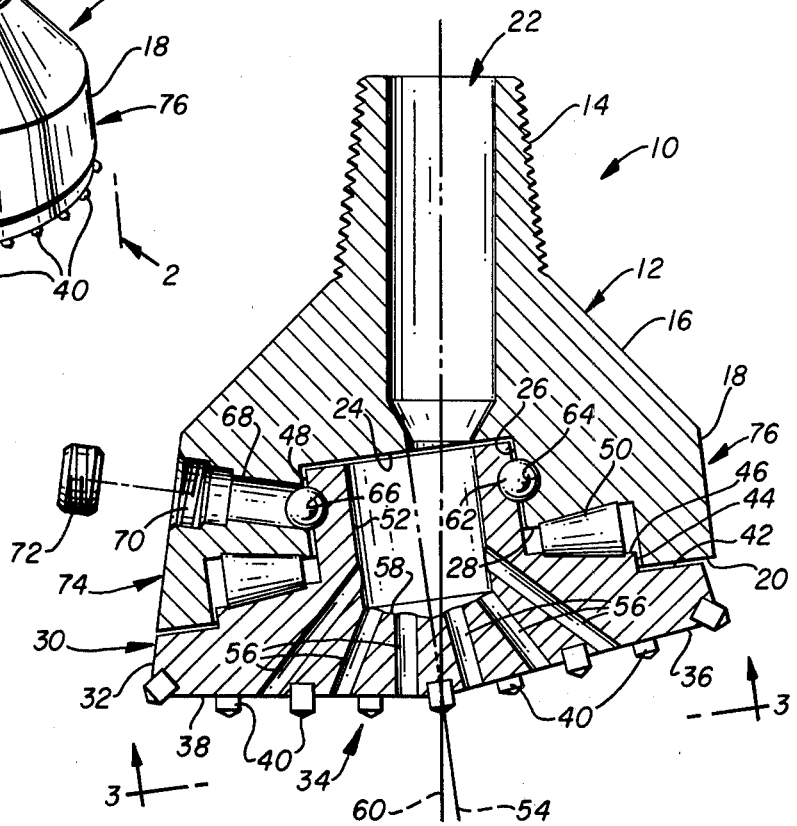
FIG. 2 is an enlarged, cross-sectional view taken along line 2—2 of FIG. 1; and, FIG. 3 is a bottom view looking in the directions indicated by the arrows at numeral 3, with some parts being broken away therefrom and some of the remaining parts being shown in cross-section.
Figure 3:
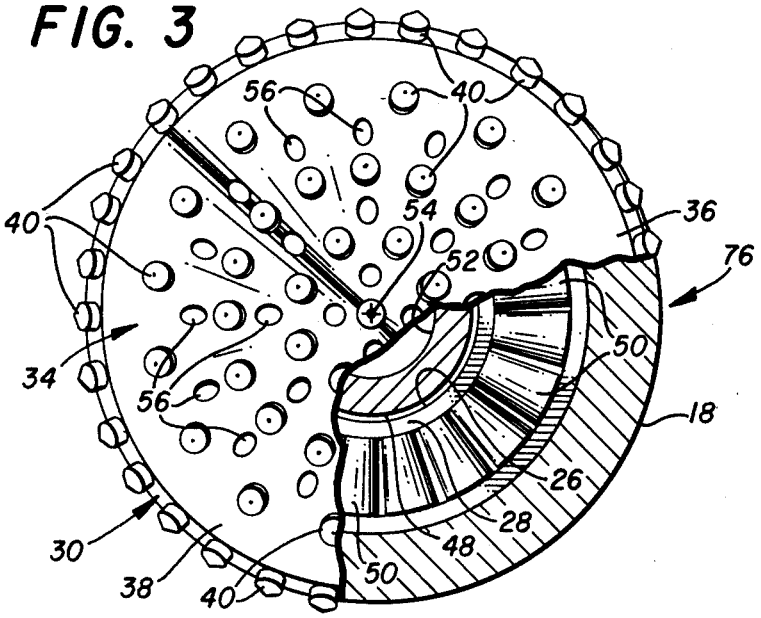

A lower relatively stationary bit member 30 is attached to the rotatable upper body member 12 so that one member can rotate relative to the other member, and hence the member 12 is referred to herein as the rotatable or upper member while the member 30 is referred to herein as the non-rotatable or lower member, it being understood that in actuality either member really can be rotated relative to the other. The non-rotatable or lower member 30 includes a circumferentially extending sidewall 32 and a lower formation engaging face 34 in the form of a conical face. As noted in FIG. 2, the conical face has an elevated side 36 opposed to a relatively lower side 38. A plurality of cutting elements, such as carbide buttons 40, are placed in various patterns on the cutting side of the lower member of the bit.

The lower member includes a circumferentially extending shoulder 42 formed about the outer marginal upper surface thereof which is located closely adjacent to the before mentioned annular face 20 of the upper member. Wall 44 provides a step up to the shoulder 46, which is concentrically located in spaced relationship respective to the shoulder 28 and forms the second of a pair of confronting bearing races, or shoulders for receiving the races of a bearing, as may be desired.

The lower member reduces in diameter and upwardly extends in the form of a hollow cylinder 48, with the cylinder terminating closely adjacent to the upper wall 24 of the chamber, and with the sidewall of the cylinder being slidably received closely adjacent to the sidewall 26 of the chamber. A plurality of taper roller bearings 50 are received between the confronting races or shoulders. A cavity 52 forms the interior of the cylinder. The cavity or counterbore and cylinder has a common axial centerline 54. The lower member 30 is symmetrical about the axial centerline 54. A plurality of passageways 56 extend from the bottom 58 of the cylinder cavity, through the lower face 34 of the lower member. Centerline 60 lies along the longitudinal axial centerline of the main body which is also axially aligned with passageway 22, and which is not aligned with axial centerline 54.

A plurality of ball bearings 62 are received within the passageway formed by grooves 64 and 66, thereby capturing the lower member respective to the main body member in low friction relationship therewith. A ball passageway 68 is threaded at 70 for receiving plug 72 so that the balls can be placed within and removed from the passageway for disassembly and servicing of the bit.

It will be noted that when the ground engaging side 38 of the conical face lies parallel to the horizontal, that the axial centerline 60 of the main body member is disposed vertically; and, there is a long wall 74 and a short wall 76 on opposed sides of the downwardly directed circumferentially extending sidewall 18 of the main body member.

In operation, the drill bit is connected to the lower end of a drill string and the string is rotated, thereby imparting rotation into the main body member. As the main body member rotates, the non-rotating member 30 is forced against the formation at the bottom of the borehole with the lower side 38 of the cone bearing against the formation and pressing downwardly with sufficient force to break up the formation into smaller pieces which are circulated up the borehole annulus by means of drilling fluid flowing through passageway 56. During this time, the opposed side 36 of the conical surface is parallel to the inclined plane 20 of the main rotatable body.

As the upper body member 12 rotates respective to the lower member 30, the pressure exerted on the face 34 continually changes with rotation of the bit because the lower or longest side 74 is continuously rotating, and accordingly, there is a rotating force placed on a limited area of one side of the conical bit face which moves circumferentially about the non-rotating member, thereby producing a force which bears against the bottom of the borehole with a wobble-like action.

I claim:

1. A rotary bit for borehole forming operations comprising:

a main rotatable body having an upper threaded end for connection to a string of drill pipe, said body has a circumferentially extending downwardly directed sidewall which terminates in an inclined plane;

an axial passageway formed into the upper end of said body; a chamber formed into the lower end of said body, said passageway and said chamber have axial centerlines which intersect one another at an angle, a first bearing race circumferentially extending about said cavity;

a lower stationary bit member having a circumferentially extending sidewall, a lower formation engaging cutting face, an upper face which includes a circumferentially extending shoulder which forms a second bearing race;

bearing means received between the first and second bearing races, said bit member includes an upwardly extending hollow cylinder having a counterbore axially aligned with respect to the sidewall of the bit member, said cylinder is slidably received within the chamber of the main body; means capturing said cylinder within said chamber;

a plurality of passageways which extend from the interior of the cylinder through the formation engaging face of the stationary bit member;

said cutting face is in the form of an inverted cone having an elevated side opposed to a lower side, the elevated side of the cone lies parallel to said inclined plane;

said hollow cylinder is in communication with said axial passageway and with said plurality of passageways.

2. The bit of claim 1 wherein a circumferentially extending groove is formed about the hollow cylinder and about a wall surface of the cavity, the two grooves cooperate to form a ball receiving passageway;

a ball passageway formed from the exterior of the main body into the ball receiving passageway for receiving balls therethrough; closure means for said ball passageway;

a plurality of balls removably received within said ball receiving passageway for rotatably capturing said main body and said lower bit member together in low friction relationship respective to each other.

3. The bit of claim 1 wherein said hollow cylinder is an integral part of said lower member and includes an axial centerline common to the axial centerline of said cavity;

each said ball receiving groove lies parallel, concentric, and spaced from said bearing means.

4. A rotary drill bit having a rotatable upper body member, an axial passageway formed through the upper end of the upper member, a downwardly opening chamber formed at the lower end of said upper member which downwardly opens along a centerline which is arranged at an angle respective to the centerline of the axial passageway;

a bearing race in the form of a circumferentially extending shoulder arranged perpendicular respective to the centerline of the chamber;

a non-rotatable lower bit member having a formation engaging face formed thereon for engaging a formation, said bit member includes a cylinder arranged perpendicular respective to said formation engaging face;

an upwardly opening cavity within said cylinder; a bearing race circumferentially disposed about said cylinder and arranged perpendicular to said cavity; fastener means for capturing said lower bit member to said upper member in low friction relationship therewith so that the upper member can be rotated respective to the lower bit member;

a flow passageway means extending from said axial passageway, through said cylinder, and through the face of the lower bit member through which fluid can circulate;

said cutting face is in the form of an inverted cone, said cone includes a ground engaging side and an elevated opposed side, said elevated side of the cone lies parallel to said inclined plane;

said hollow cylinder is in communication with said axial passageway and with said plurality of passageways.

5. The drill bit of claim 4 wherein a circumferentially extending groove is formed about the hollow cylinder and about a wall surface of the cavity, the two grooves cooperate to form a ball receiving passageway;

a ball passageway formed from the exterior of the main body into the body receiving grooves for receiving balls therethrough; closure means for said ball passageway;

a plurality of balls removably received within the ball receiving grooves for rotatably capturing said main body and said lower bit member together in low friction relationship respective to each other.

6. The bit of claim 5 wherein said hollow cylinder is an integral part of said lower bit member and includes an axial centerline common to the axial centerline of said cavity;

each said ball receiving groove lies parallel, concentric, and spaced from said bearing means.

* * * * *

UNITED STATES PATENT AND TRADEMARK OFFICE

CERTIFICATE OF CORRECTION

PATENT NO. : 4,372,403

DATED : FEBRUARY 8, 1983

INVENTOR(S) : ARCHIE W. BEEMAN

It is certified that error appears in the above—identified patent and that said Letters Patent is hereby corrected as shown below:

Claim 5, Column 6, line 15, substitute --ball-- for "body" (second occurrence).

Signed and Sealed this

*Twentieth* Day of *September 1983*

[SEAL]

*Attest:*

GERALD J. MOSSINGHOFF

*Attesting Officer*

*Commissioner of Patents and Trademarks*